US011661742B2

(12) United States Patent
Bogdan et al.

(10) Patent No.: US 11,661,742 B2
(45) Date of Patent: May 30, 2023

(54) STEEL REINFORCED CONCRETE COLUMN

(71) Applicant: ArcelorMittal, Luxembourg (LU)

(72) Inventors: Teodora Bogdan, Esch-sur-Alzette (LU); Jean-Claude Gerardy, Esch-sur-Alzette (LU); Nicoleta Popa, Heinstert (BE); Olivier Vassart, Bertrange (LU); Donald W. Davies, Seattle, WA (US); Congzhen Xiao, Beijing (CN); Tao Chen, Beijing (CN); Fei Deng, Beijing (CN); Antony Wood, Chicago, IL (US); Dario Trabucco, Venice (IT); Eleonora Lucchese, Venice (IT)

(73) Assignee: ArcelorMittal, Luxembourg (LU)

( * ) Notice: Subject to any disclaimer, the term of this patent is extended or adjusted under 35 U.S.C. 154(b) by 218 days.

(21) Appl. No.: 16/341,623

(22) PCT Filed: Oct. 14, 2016

(86) PCT No.: PCT/IB2016/056159

§ 371 (c)(1),
(2) Date: Apr. 12, 2019

(87) PCT Pub. No.: WO2018/069752

PCT Pub. Date: Apr. 19, 2018

(65) Prior Publication Data

US 2021/0230859 A1 Jul. 29, 2021

(51) Int. Cl.
*E04C 3/34* (2006.01)
*E04B 1/30* (2006.01)
(Continued)

(52) U.S. Cl.
CPC ..... *E04C 3/34* (2013.01); *E04B 1/30* (2013.01); *E04C 3/32* (2013.01); *E04C 5/0622* (2013.01)

(58) Field of Classification Search
CPC ..... E04B 1/30; E04C 3/32; E04C 3/34; E04C 5/0622; E02D 5/28; E02D 5/665; E02D 5/30
See application file for complete search history.

(56) References Cited

U.S. PATENT DOCUMENTS 199,887 A * 1/1878 Wight ..... E04C 3/34 52/423
732,485 A * 6/1903 Wight ..... E04C 3/34 52/649.3
(Continued)

FOREIGN PATENT DOCUMENTS

CA 1039071 A * 9/1978 ..... E02D 5/28
CN 1793587 A 6/2006
(Continued)

OTHER PUBLICATIONS

International Search Report and Written Opinion dated Jun. 6, 2017, for International Application No. PCT/IB2016/056159 (9 pages).
(Continued)

*Primary Examiner* — Jessie T Fonseca
(74) *Attorney, Agent, or Firm* — Fitch Even Tabin & Flannery LLP

(57) ABSTRACT

A steel reinforced concrete column for a high rise building comprises a plurality of hot-rolled steel sections extending longitudinally through the concrete column. Each of these steel sections has an outward flange with an outer surface turned outwards in the concrete column, an opposite inward flange with an outer surface turned inwards in the concrete column, and a web connecting the outward flange to the inward flange. The steel sections are arranged in the concrete column so that the outer surfaces of their inward flanges at least partially delimit therein a central concrete core with n lateral sides and a transversal cross-section that forms an n-sided polygon, n being at least equal to three, and each of
(Continued)

then lateral sides of the central concrete core being coplanar with the outer surface of the inward flange of at least one steel section.

29 Claims, 5 Drawing Sheets

(51) Int. Cl.
*E04C 3/32* (2006.01)
*E04C 5/06* (2006.01)

(56) References Cited

U.S. PATENT DOCUMENTS 812,223 A * 2/1906 Mouchel ..... E02D 5/30 405/256
971,353 A * 9/1910 Brayton et al. ..... 52/600
1,655,407 A * 1/1928 Bennett ..... E04C 3/34 52/423
1,924,346 A * 8/1933 Blumenthal ..... E02D 5/665 405/232
1,998,017 A * 4/1935 Jaekle ..... E02D 5/28 405/231
2,075,262 A * 3/1937 Boettner ..... E04B 1/4178 52/99
3,245,190 A * 4/1966 Reiland ..... E04C 3/34 52/649.3
3,798,867 A * 3/1974 Starling ..... E04G 23/0225 52/834
4,018,055 A * 4/1977 Le Clercq ..... E02D 5/30 405/257
4,019,301 A * 4/1977 Fox ..... E02D 5/60 52/834
4,239,176 A * 12/1980 Salazar ..... B28B 7/0029 249/160
4,317,643 A * 3/1982 Miller ..... E02D 5/30 405/239
6,006,488 A * 12/1999 Okitomo ..... E02D 5/60 52/834
6,561,736 B1 * 5/2003 Doleshal ..... E02D 27/52 405/211
8,484,915 B1 * 7/2013 Abbas ..... E04C 3/34 52/223.4
10,208,493 B1 * 2/2019 Sim ..... E04C 3/34
10,253,500 B2 * 4/2019 Edoo ..... E04C 5/07
2005/0055922 A1 * 3/2005 Shamsai ..... E04C 5/06 52/319
2007/0278380 A1 * 12/2007 Marker ..... E04C 3/34 249/189
2008/0222976 A1 * 9/2008 Liskey ..... E02D 27/42 52/169.9
2021/0047825 A1 * 2/2021 Mou ..... E04H 9/021

FOREIGN PATENT DOCUMENTS

CN 102409807 A 4/2012
CN 203113624 U 8/2013
CN 104405082 A 3/2015
CN 104652705 A 5/2015
CN 204919988 U 12/2015
CN 105421586 A 3/2016
JP 2000027368 A * 1/2000
JP 2000027369 A * 1/2000
JP 3402312 B2 * 5/2003
JP 2005351078 A * 12/2005
WO WO-2014006824 A1 * 1/2014 ..... E04B 1/30
WO WO-2017170732 A1 * 10/2017 ..... E04B 1/30

OTHER PUBLICATIONS

International Preliminary Report on Patentability dated Dec. 10, 2018, for International Application No. PCT/IB2016/056159 (15 pages).

* cited by examiner

STEEL REINFORCED CONCRETE COLUMN

TECHNICAL FIELD

The present invention generally relates to a steel reinforced concrete column for a high rise building. It further relates to a steel structure for such a steel reinforced concrete column and a high-rise building comprising such a steel reinforced concrete column.

BACKGROUND ART

Steel reinforced concrete columns are composite columns comprising structural steel sections encased in reinforced concrete. They are widely used in high-rise buildings and, due to their sizes, are also referred to as "mega-columns". Taking advantage of the composite action between the concrete and the steel sections, the bearing capacity of the composite column is normally larger than the sum of the bearing capacities of the isolated concrete and steel sections.

A first type of steel reinforced concrete columns has a welded steel skeleton that consists of heavy steel plates assembled on site by welding. Such a column is for example disclosed in Chinese utility model CN 204919988 U. The steel skeleton of this column comprises a cross-shaped section that is centred on the longitudinal central axis of the column. The section of the column itself is square-shaped, wherein cages of rebars reinforce the four corners of the column. It is also known to design the steel skeleton as a huge steel caisson consisting of heavy steel plates assembled on site by welding. This steel caisson is filled with concrete and encased in concrete reinforced with longitudinal and transversal rebars.

It is further known to combine open steel sections with closed steel sections in a steel reinforced concrete column. Such a column is for example disclosed in Chinese utility model CN 104405082 U. This column has a cross-shaped cross-section. Each arm of the cross includes a welded T-shaped steel section having a web pointing to the centre of the cross. In the centre of the column, a tubular steel section is embedded in the concrete and filled with concrete.

In steel reinforced concrete columns of this first type the design of the steel skeleton can be freely designed so that the concrete and the steel efficiently cooperate. However, building such a steel skeleton generally requires a lot of onsite welding work on heavy structural steel, which is costly, time consuming and may result in quality problems.

A second type of steel reinforced concrete columns includes isolated hot-rolled steel sections. Such a column is for example disclosed in Chinese utility model CN 203113624 U. The steel reinforced concrete column disclosed therein has a square-shaped or rectangular cross-section, wherein an I-section steel beam is arranged in each of the corners of the column. The webs of these I-section steel beams are arranged along two opposite sides of a concrete core that is reinforced with longitudinal and transversal rebars. In case of a rectangular cross-section of the column, the webs of the four I-section beams are located along the small sides of the column. Rebar rings surround pairs of I-section beams and the whole arrangement of I-sections.

Steel reinforced concrete columns of this second type do not require a lot of onsite welding work on heavy structural steel, but they are generally less efficient as regards the cooperation between the concrete and the steel sections for warranting a high bearing capacity.

It is an object of the present invention to propose a steel reinforced concrete column that is easy to build on site and in which the concrete and the steel nevertheless efficiently cooperate to warrant a high bearing capacity.

SUMMARY OF INVENTION

A steel reinforced concrete column for a high rise building in accordance with the invention comprises a plurality of hot-rolled steel sections extending longitudinally through the concrete column, wherein each of these steel sections has an outward flange with an outer surface turned outwards in the concrete column, an opposite inward flange with an outer surface turned inwards in the concrete column, and a central web connecting the outward flange to the inward flange. Preferred hot rolled steel sections are, for example, H-shaped steel sections with wide flanges, such as European HEA, HEB or HEM beams according to prEN16828-2015, EN 10025-2:2004, 10025-4:2004, or American wide flange or W-beams according to ASTM A6/A6M-14, or other hot-rolled steel section having two flanges and a central web similar to or in line with the aforementioned beams. The steel reinforced concrete column has a longitudinal axis along which the steel sections extend, preferably so that the longitudinal axis of each steel section is parallel to the longitudinal axis of the steel reinforced concrete column.

According to a first aspect of the invention, the steel sections are arranged in the concrete column so that the outer surfaces of their inward flanges delimit therein a central concrete core with n lateral sides and a transversal cross-section that forms an n-sided polygon, n being at least equal to three, wherein each of the n lateral sides of the central concrete core is coplanar with the outer surface of the inward flange of at least one steel section. It will be understood that "coplanar" here means that the respective lateral side of the central concrete core and the outer surface of the inward flange lie in a same plane, of course, within the bounds of flatness tolerances of the outer surface of the inward flange. What matters is that the outer surface of the inward flange forms an outward boundary for the central concrete core. It follows that confinement of the central concrete core—which is usually solely ensured by external reinforced concrete layers—is improved by a specific arrangement of the inward flanges of the steel sections. "Confinement" here means a blocking of transversal expansion of the concrete under compression forces. As a result of the improved confinement of the concrete core, a 3D stress state is developed in the concrete core which increases the bearing capacity and ductility of the steel reinforced concrete column. Crack expansion and growth are minimized in the axially compressed concrete core. It remains to be noted that the confinement effect is not (yet) taken into consideration in the design codes, but it surely provides extra safety to the user. In summary, the present invention proposes a steel reinforced concrete column that can be easily built on site with hot-rolled steel sections, wherein these sections do not only provide a high bearing capacity but also increase the bearing capacity of the central concrete core.

To improve the confinement of the central concrete core by the inward flanges, preferably at least 30% and more preferably at least 40% and most preferably at least 50% of the surface of each of the n lateral sides of the concrete core shall be limited by the outer surface of the inward flange of one or more steel sections.

Furthermore, the horizontal distance between two adjacent steel sections in the column shall at least be several centimetres, so that each of the individual steel sections is sufficiently embedded in concrete. It follows that at maximum 98% of the surface of each of the n lateral sides of the concrete core will normally be limited by the outer surface of the inward flange of one or more steel sections. In preferred embodiments, the percentage of the surface of each of the n lateral sides of the concrete core that is limited by the outer surface of the inward flange of one or more steel sections will be in the range of 30% to 98%, and more preferably in the range of 30% to 80% or 40% to 80%.

If a side of the central concrete core is coplanar with the outer surface of the inward flange of a single steel section, then this inward flange is preferably centred relative to the width of this side of the central concrete core. Such a centred arrangement of the inward flange provides a good confinement of the central concrete core and good possibilities of connecting a bearing beam to the column.

It will be appreciated that the cross-section of a proposed steel reinforced concrete column—and thereby its bearing capacity—may be easily increased without degrading the confinement of the central concrete core, if there are sides of the central concrete core that are coplanar with the outer surfaces of the inward flanges of more than one steel section.

To improve the confinement of the central concrete core, if a side of the central concrete core is coplanar with the outer surfaces of the inward flanges of m steel sections, wherein m is at least equal to two, the distance between two consecutive inward flanges arranged along this side of the central concrete core, as well as the distance between a corner laterally delimiting this side of the central concrete core and the inward flange closest to this corner, shall preferably not be greater than $0.8 \cdot w/(m+1)$, preferably not greater than $0.7 \cdot w/(m+1)$, where w is the width of this side and m is the number of steel sections arranged along this side.

Usually, all the inward flanges will have the same width. In special cases, the inward flanges may however have different widths.

Usually, the inward flange of a steel section will have the same width as its outward flange. In special cases, the inward flange may however be wider than the outward flange.

Usually, all steel sections will have the same dimensions. In special cases, the steel sections of different dimensions may however be used in the same column.

An excellent confinement of the central concrete core can be easily achieved, if the latter has a transversal cross-section that forms an n-sided convex polygon. However, as long as it is possible to arrange at least one steel section along each side of the central concrete core, it is not excluded that the latter may have transversal cross-section forming an n-sided concave polygon, such as e.g. a star. (A convex polygon is defined as a polygon with all its interior angles less than 180°. A concave polygon has at least one angle greater than 180°.)

In many cases, the n sides of the central concrete core will all have a same width. However, it is not excluded that the n sides of the central concrete core may have different widths. This is for example the case if the central concrete core has a transversal cross-section that is a rectangle.

It will be appreciated that excellent confinement of the central concrete core can be achieved, if this central core has a transversal cross-section that forms a regular polygon, i.e. a polygon that is equiangular (all angles are equal in measure) and equilateral (all sides have the same length). However, architectural and/or structural constraints (e.g. bearing directions of beams connected to the column) may imply to confer to the central concrete core a transversal cross-section that forms a polygon that is not equiangular and/or not equilateral.

Similarly, to improve confinement of the central concrete core, it is of advantage if the steel sections form an arrangement of which the longitudinal central axis of the column is an axis of rotation symmetry of 360°/n, wherein n is the number of sides of the central concrete core.

If a side of the central concrete core is coplanar to the outer surface of the inward flange of a single steel section, confinement of the central concrete core is also improved if the web of this steel section has a midplane containing, with the usual tolerances for such a structural steel application, the longitudinal axis of the column.

Each inward flange preferably comprises a multitude of shear connectors penetrating into the central concrete core. These shear connectors provide the advantage that the arrangement of steel sections and the central concrete core behave more effectively as a composite body, whereby the ability of the steel reinforced concrete column to withstand bending stresses induced by eccentric column loads is strongly improved.

Each of the steel sections may additionally or alternatively comprise a multitude of shear connectors penetrating into the concrete between its outward and inward flanges and/or into the concrete surrounding the outer surface of its outward flange. These shear connectors provide the advantage that the steel sections and the concrete enveloping the steel sections behave more effectively as a composite body.

The concrete will generally comprise longitudinal and/or transversal rebars, wherein "rebar" is a shortened form for "reinforcing bar" and designates a steel bar used as a tension device to strengthen and hold the concrete in tension, the surface of the rebar being often patterned to form a better bond with the concrete.

In a preferred embodiment, the concrete comprises an outer reinforcement cage formed of longitudinal and transversal rebars and enclosing the arrangement of steel sections. This outer concrete reinforcement cage allows in particular an outer confinement of a peripheral concrete layer encaging the steel sections. It opposes in particular a bulging of this peripheral concrete layer under axial compression forces, so that this peripheral concrete layer may contribute up to higher loads to the bearing capacity of the steel reinforced concrete column.

The outer reinforcement cage advantageously comprises multitude of closed circular rebar rings connected to the longitudinal rebars. It will be appreciated that these closed circular rebar rings efficiently oppose a transversal pressure generated in the axially compressed concrete, by being capable of absorbing important circumferential tension stresses (similar to a cylindrical wall of a pressure vessel).

The concrete may also advantageously comprise an inner reinforcement cage formed of longitudinal and transversal rebars, which is arranged between the outer flanges and the inward flanges so as to enclose the central concrete core. This inner concrete reinforcement cage provides in particular a confinement of an intermediate concrete layer immediately surrounding the central concrete core. It thereby opposes a transversal pressure generated in this intermediate concrete layer under axial compression forces, so that this intermediate concrete layer may contribute up to higher loads to the bearing capacity of the steel reinforced concrete column.

The inner reinforcement cage preferably comprises closed circular rebar rings passing through holes in the webs of the steel sections. It follows that these rings are structurally independent from the arrangement of steel sections, which is of advantage when the steel sections are exposed to deformations. Alternatively, the inner reinforcement cage comprises arc-shaped segments of rebar rings welded with their ends to the webs of the steel sections. While being less advantageous from the structural point of view, this alternative embodiment has however the non-negligible advantage that it is not necessary to drill holes into the webs of the steel sections.

In a preferred embodiment, the steel reinforced concrete column comprises at least two longitudinally spaced beam-to-column connection nodes. Such a "beam-to-column connection node" is a specific section of the steel reinforced concrete column that is specifically equipped for connecting thereto load bearing beams supporting for example a floor in a high rise building. It will be appreciated that between two successive beam-to-column connection nodes, there is advantageously no structural steel interconnecting the steel sections. In other words, between two successive beam-to-column connection nodes, the bearing steel structure of the steel reinforced concrete column just consists of isolated steel sections extending in parallel through the column. At the beam-to-column connection nodes, the steel sections may however be structurally interconnected by means of structural steel. The term "structural steel" herein designates a variety of heavy steel shapes, such as H-beams, I-beams, T-beams, heavy U- or L-sections and heavy steel plates, used as load bearing or load transferring members in a steel structure. Rebars are, in this context, not considered as structural steel. Thanks to the absence of structural steel interconnecting the steel sections between two successive beam-to-column connection nodes, onsite welding work on structural steel is strongly limited which improves notably the quality of the column and makes the latter easier to build.

In a preferred embodiment, the steel reinforced concrete column comprises at least one beam-to-column connection element on the outward flange of at least one steel section for connecting to this outward flange a load bearing beam. Such a beam-to-column connection element may for example comprise a structural steel element, such as for example: L-sections rigidly affixed to the outward flange, for welding or bolting thereto the web of the beam; bolt holes in the outward flange, for fixing an end plate of beam to the outward flange, so as to achieve a bolted end plate beam-to-column connection etc. The beam-to-column connection shall preferably be a rigid beam-to-column connection.

The steel reinforced concrete column may have a round or oval or another curvilinear cross-section, but it may also have a polygonal cross-section. The present invention consequently offers considerable architectural freedom for designing the cross-section of the column. It will however be appreciated that a very interesting embodiment comprises a polygonal cross-section with 2n sides, if the central concrete core has n sides. Behind every second of these 2n sides will then be arranged the outer surface of the outward flange of at least one of the steel sections. It will be appreciated that such an embodiment allows, amongst others, to efficiently avoid protruding concrete corners that do not comprise a steel section.

The invention also proposes a steel structure for a steel reinforced concrete column for a high rise building comprising a plurality of hot-rolled steel sections arranged so as to extend longitudinally through the concrete column. Each of these steel sections has an outward flange with an outer surface turned outwards in the concrete column, an opposite inward flange with an outer surface turned inwards of the concrete column, and a web connecting the outward flange to the inward flange. The steel sections are arranged so that the outer surfaces of their inward flanges delimit a central core volume with n lateral sides and a transversal cross-section that forms a n-sided polygon, n being at least equal to three; each of the n lateral sides of the central core volume being coplanar to the outer surface of the inward flange of at least one steel section. As soon as such steel structure is encased in concrete, the central concrete core is confined or limited by the inward flanges of the steel sections. As explained hereinbefore, with the improved confinement of the concrete core, a 3D stress state is developed in the concrete core which increases the bearing capacity and ductility of the steel reinforced concrete column. Crack expansion and growth are minimized in the axially compressed concrete core.

Such a steel structure normally also comprises at least two longitudinally spaced beam-to-column connection nodes for connecting thereto load bearing beams; wherein between two successive beam-to-column connection nodes, there is no structural steel interconnecting the steel sections. At the beam-to-column connection nodes, the steel sections may be structurally interconnected by means of structural steel. Thanks to the absence of structural steel interconnecting the steel sections between two successive beam-to-column connection nodes, onsite welding work on structural steel is strongly limited which improves notably the quality of the steel structure and makes the latter easier to build.

The invention further proposes a high-rise building comprising at least one steel reinforced concrete column as described hereinbefore.

This high rise building usually comprises at least two successive floors supported by the steel reinforced concrete column at two successive beam-to-column connection nodes of the steel reinforced concrete column, wherein between two successive connection nodes, there is no structural steel interconnecting the steel sections.

BRIEF DESCRIPTION OF DRAWINGS

The afore-described and other features, aspects and advantages of the invention will be better understood with regard to the following description of several embodiments of the invention and upon reference to the attached drawings, wherein.

DETAILED DESCRIPTION OF AN EMBODIMENT OF THE INVENTION

Figure 1:
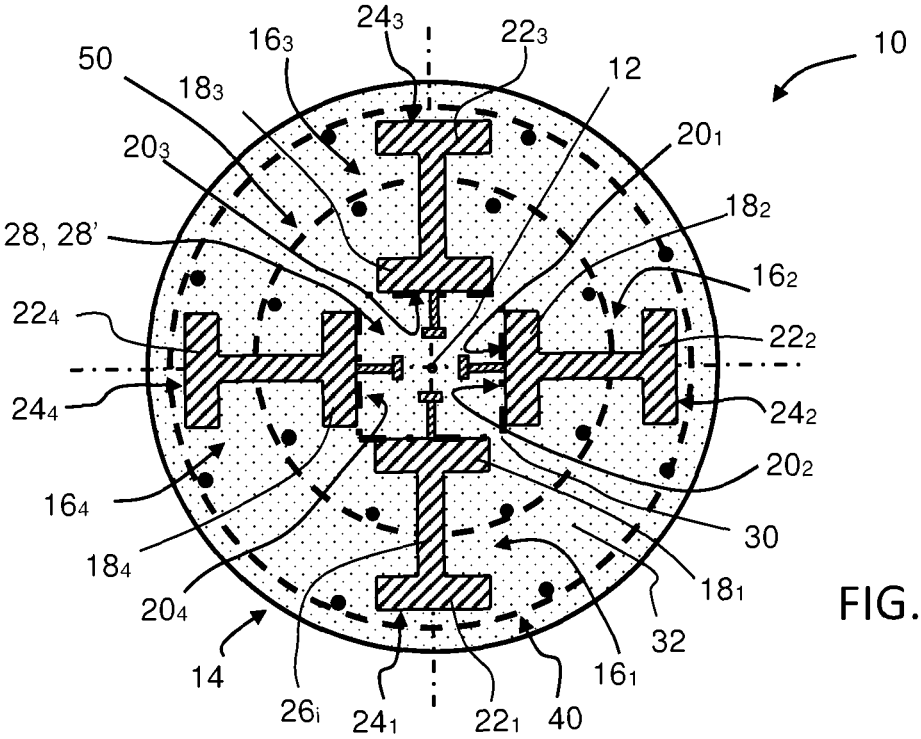
FIG. 1: is a cross-section of a first embodiment of a steel reinforced concrete column in accordance with the invention.

It will be understood that the following description and drawings describe embodiments of the invention by way of example and for illustration purposes. They shall not limit the scope, nature or spirit of the claimed subject matter. In the drawings, equivalent elements in different embodiments bear the same reference numbers.

FIG. 1 schematically shows a cross-section of a first embodiment of a steel reinforced concrete column 10 in accordance with the invention (also designated in a shortened form as "the column 10"). The column 10 comprises a longitudinal central axis 12 and a shell surface (or outer envelope) 14. The longitudinal central axis 12 is perpendicular to the drawing plane. In the column of FIG. 1, the shell surface 14 is a right circular cylindrical surface having the longitudinal central axis 12 as cylinder axis. It follows that the column of FIG. 1 has a circular cross-section.

Four hot-rolled steel sections $\mathbf{16}_1$, $\mathbf{16}_2$, $\mathbf{16}_3$, $\mathbf{16}_4$ with an H-shaped section (hereinafter also designated in a shortened form as "steel sections $\mathbf{16}_i$", where i=1, 2, 3, 4) extend longitudinally along the longitudinal central axis 12 of the column 10. Each of these column beams $\mathbf{16}_i$ has an inward flange $\mathbf{18}_i$ with a substantially planar outer surface $\mathbf{20}_i$ turned inwards (i.e. turned to the longitudinal central axis 12), an opposite outward flange $\mathbf{22}_i$ with a substantially planar outer surface $\mathbf{24}_i$ turned outwards (i.e. turned to the shell surface 14 of the column 10), and a central web $\mathbf{26}_i$ connecting the inward flange $\mathbf{18}_i$ to the outward flange $\mathbf{20}_i$. The midplane of the web $\mathbf{26}_i$ of each steel section $\mathbf{16}_i$ contains hereby the longitudinal central axis 12 of the column 10.

Preferred hot rolled steel sections are H-shaped steel sections with wide flanges, such as European HEA, HEB or HEM beams according to prEN16828-2015, EN 10025-2: 2004, 10025-4:2004, or American wide flange or W-beams according to ASTM A6/A6M-14, or other hot-rolled H-shaped steel section similar to or in line with the aforementioned beams. Relevant mechanical parameters and steel grades of suitable steel sections are for example listed in European standard EN 1993-1-1:2005, Table 3.1 and clause 3.2.6.

The four steel sections $\mathbf{16}_i$ are arranged in the column 10 so that the outer surfaces $\mathbf{20}_i$ of their inward flanges $\mathbf{18}_i$ delimit therein a central core volume 28 with four lateral sides and a transversal cross-section that forms a four-sided polygon. Reference number 30 identifies the outer limit of this central core volume 28 in the plane of the drawing, which outer limit has the form of a square in FIG. 1. In space, the outer limit (i.e. the enveloping surface) of the central core volume 28 is defined by four virtual planes, each of these four virtual planes being coplanar with the outer surfaces $\mathbf{20}_i$ of one of the four inward flanges $\mathbf{18}_i$. The longitudinal central axis 12 of the column 10 is also the central axis of the central core volume 28.

Concrete 32 (schematically represented by a dotted pattern fill) encases the four steel sections $\mathbf{16}_i$ and also fills the central core volume 28 delimited by the outer surfaces $\mathbf{20}_i$ of the inward flanges $\mathbf{18}_i$ of the four steel sections $\mathbf{16}_i$. Consequently, the column 10 comprises a central concrete core 28' with four lateral sides and a transversal cross-section that forms a four-sided polygon, more particularly a square, wherein each of the four lateral sides of the central concrete core 28' is coplanar with the outer surface $\mathbf{20}_i$ of the inward flange of one of the steel section $\mathbf{16}_i$.

It follows that confinement of the central concrete core 28', which is usually solely provided by external reinforced concrete layers, is improved by a specific arrangement of the inward flanges $\mathbf{18}_i$ of the steel sections $\mathbf{16}_i$. This confinement very efficiently blocks a transversal expansion of the concrete under compression forces. As a result of the improved confinement of the concrete core 28', a 3D stress state is developed in the concrete core which increases the bearing capacity and ductility of the steel reinforced concrete column 10. Crack expansion and growth are minimized in the axially compressed concrete core. It remains to be noted that the confinement effect is not (yet) taken into consideration in the design codes, but it surely gives an extra safety to the user.

Suitable concrete to be used for encasing the hot-rolled steel sections and filling the central core volume 28 is for example in accordance with European standard EN 1992-1-1:2004 Table 3.1 or with equivalent other standards. If high strength steel material is used for the steel sections, then it is recommended to have high strength concrete material too.

To achieve a sufficient confinement of the central concrete core 28', at least 30% of the surface of each of the four lateral sides of the concrete core 28' shall be limited by the outer surface $\mathbf{20}_i$ of the inward flange $\mathbf{18}_i$ of the respective steel section $\mathbf{16}_i$. In FIG. 1, each of the inward flanges $\mathbf{18}_i$ is centrally located on the respective side of the central concrete core 28' and limits about 78% of the surface of this side. In other words, the central concrete core 28' is limited by the inward flanges $\mathbf{18}_i$ over about 78% of its perimeter surface 30.

Figure 5:
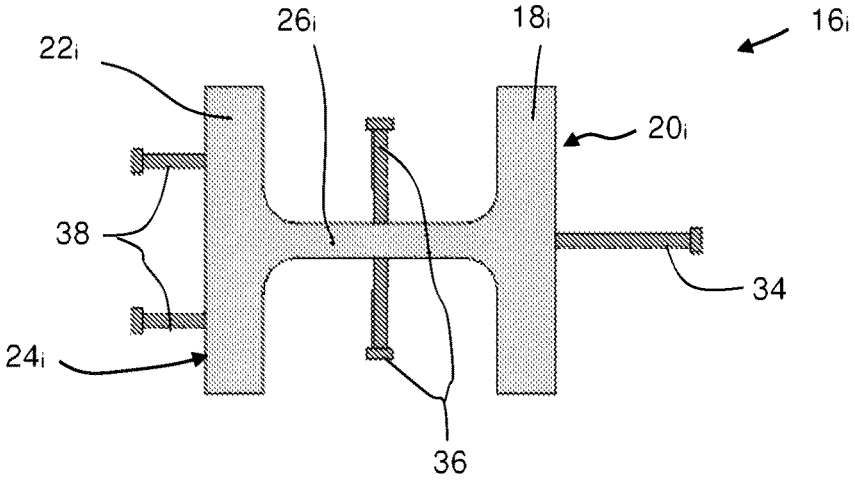
FIG. 5: is a cross-section of a steel section to be used in a steel reinforced concrete column in accordance with the invention.

Combining FIG. 5 with FIG. 1, it will be understood that each inward flange $\mathbf{18}_i$ preferably comprises a multitude of shear connectors 34 protruding from its outer surface $\mathbf{20}_i$. These shear connectors 34 deeply penetrate into the central concrete core 28'. As a consequence, the central concrete core 28' is fully bonded to the four inward flanges $\mathbf{18}_i$ of the steel sections $\mathbf{16}_i$, i.e. the connectors fully transfer shear stresses at the flange-concrete core interfaces. It follows that a composite steel concrete column 10 is formed that takes full advantage of the high compressive strength of the confined central concrete core 28' and of the high tensile and compressive strength of the steel sections $\mathbf{16}_i$.

As solely illustrated in FIG. 5, each of the steel sections $\mathbf{16}_i$ may further comprise shear connectors 36 penetrating into the concrete 32 between its outward flange $\mathbf{22}_i$ and its inward flange $\mathbf{18}_i$ and/or shear connectors 38 penetrating into the concrete 32 surrounding the outer surface $\mathbf{24}_i$ of its outward flange $\mathbf{22}_1$. All the shear connectors 34, 36, 38 shown in the drawings are headed shear studs, but it is not excluded to use other types of shear connectors, as long as they are capable of properly transferring the shear stresses at the respective concrete-steel interfaces.

Figure 3A:
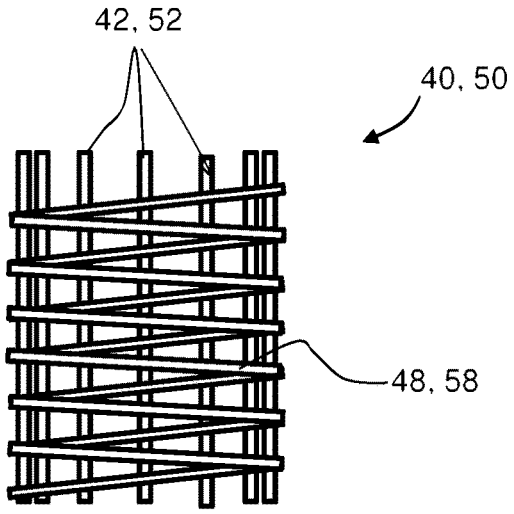
FIG. 3A: is an elevation view of a first embodiment of a steel concrete reinforcement cage to be used in a steel reinforced concrete column in accordance with the invention.
Figure 4A:
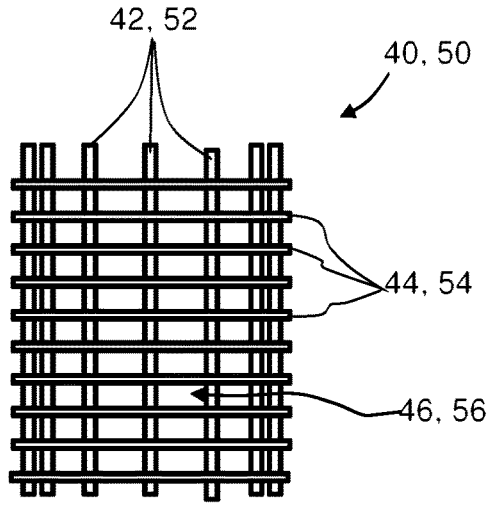
FIG. 4A: is an elevation view of a second embodiment of a steel concrete reinforcement cage to be used in a steel reinforced concrete column in accordance with the invention.
Figure 3B:
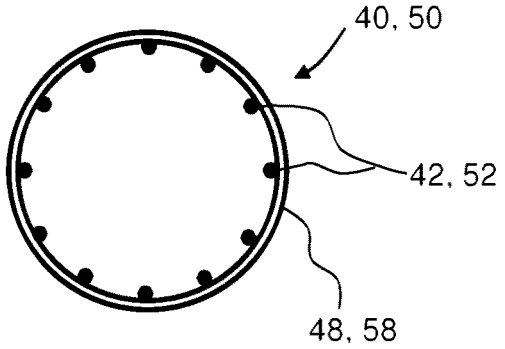
FIG. 3B: is a cross-section of the steel concrete reinforcement cage of FIG. 3A.
Figure 4B:
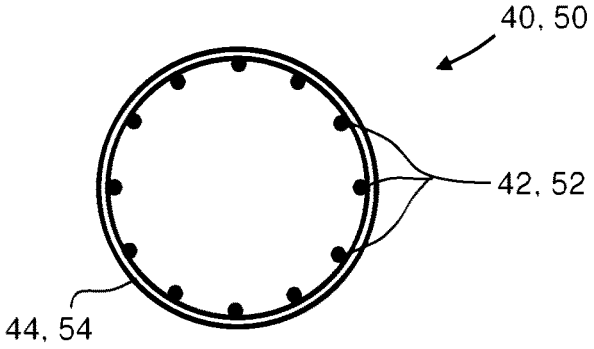
FIG. 4B: is a cross-section of the steel concrete reinforcement cage of FIG. 4A.

In FIG. 1, reference number 40 identifies an outer reinforcement cage surrounding the four steel sections $\mathbf{16}_i$ in the concrete 32. A preferred embodiment of such a concrete reinforcement cage 40 is illustrated by FIGS. 4A and 4B, wherein a side view thereof is shown in FIG. 4A and a cross-section thereof is shown in FIG. 4B. In this preferred embodiment, the concrete reinforcement cage 40 comprises reinforcement bars 42 longitudinally extending through the column 10 (also called longitudinal rebars 42) and closed circular reinforcement rings 44 (also called closed circular rebar rings). The closed circular reinforcement rings 44 are manufactured from at least one rebar, which is bent to have the shape of a circular ring, which ring is then closed by welding together the two ends of the rebar. The closed circular reinforcement rings 44, which are in the column 10 preferably parallel to a horizontal plane and have their centre located on the longitudinal central axis 12, are secured to all or some of the longitudinal rebars 42 preferably by welding, or alternatively by mechanical connections, such as e.g. tying steel wire or mechanical couplers. Geometrical and material characteristics of the steel rebars are defined for example in EN 1992-1-1:2004, EN 10080, table 6, and EN 1992-1-1:2004, section 3.2.2. (3). It will be appreciated that the closed circular rebar rings 44 efficiently oppose a bursting of the axially compressed concrete 32 by being capable of absorbing substantial circumferential tension stresses (similar to a cylindrical wall of a pressure vessel). FIGS. 3A and 3B show an alternative embodiment of the outer reinforcement cage 40. In this embodiment, a continuous rebar 48 is wound in a helical form around the longitudinal rebars 42. The helically wound continuous rebar 48 is secured to all or some of the longitudinal rebars 42 preferably by welding, or alternatively by mechanical connections, such as e.g. tying steel wire or mechanical couplers. It remains to be noted that the outer concrete reinforcement cage 40 warrants an outer confinement of a peripheral concrete layer encaging the steel sections $\mathbf{16}_i$. It opposes in particular a bulging of this peripheral concrete layer under axial compression forces, so that this peripheral concrete layer may contribute up to higher loads to the bearing capacity of the steel reinforced concrete column 10.

Reference number 50 identifies an inner concrete reinforcement cage arranged between the outer flanges $\mathbf{22}_i$ and the inward flanges $\mathbf{18}_i$ so as to enclose the central concrete core 28'. Preferred embodiments of this inner concrete reinforcement cage 50 are also illustrated by FIG. 3A, 3B and FIG. 4A, 4B. Just as the outer reinforcement cage 40, the inner reinforcement cage 50 advantageously comprises vertical reinforcement bars 52 (also called longitudinal rebars 52) and closed circular reinforcement rings 54 as shown in FIG. 4A and FIG. 4B or a continuous rebar 58 that is wound in a helical form around the longitudinal rebars 52 as shown in FIG. 3A and FIG. 3B. The closed circular reinforcement rings 54 and the helically wound continuous rebar 58 advantageously pass through small holes drilled into the webs $\mathbf{26}_i$. Alternatively, to avoid drilling of holes into the webs $\mathbf{26}_i$, a closed circular reinforcement ring 54 may be replaced by four arcs of a circle, wherein the ends of each of these arcs are welded to two adjacent webs $\mathbf{26}_i$. It will be appreciated that the inner concrete reinforcement cage 50 warrants in particular a confinement of an intermediate concrete layer immediately surrounding the central concrete core 28'. It thereby blocks a transversal expansion of the concrete under compression forces, so that this intermediate concrete layer may contribute up to higher loads to the bearing capacity of the steel reinforced concrete column 10.

It remains to be noted that an embodiment with four steel sections $\mathbf{16}_i$ in a cross-shaped arrangement as shown FIG. 1, but also the embodiments of FIGS. 2 and 6 described hereinafter, are of particular interest, if the column 10 has to support horizontal bearing beams arranged according to two perpendicular directions, which is the most common case.

Figure 2:
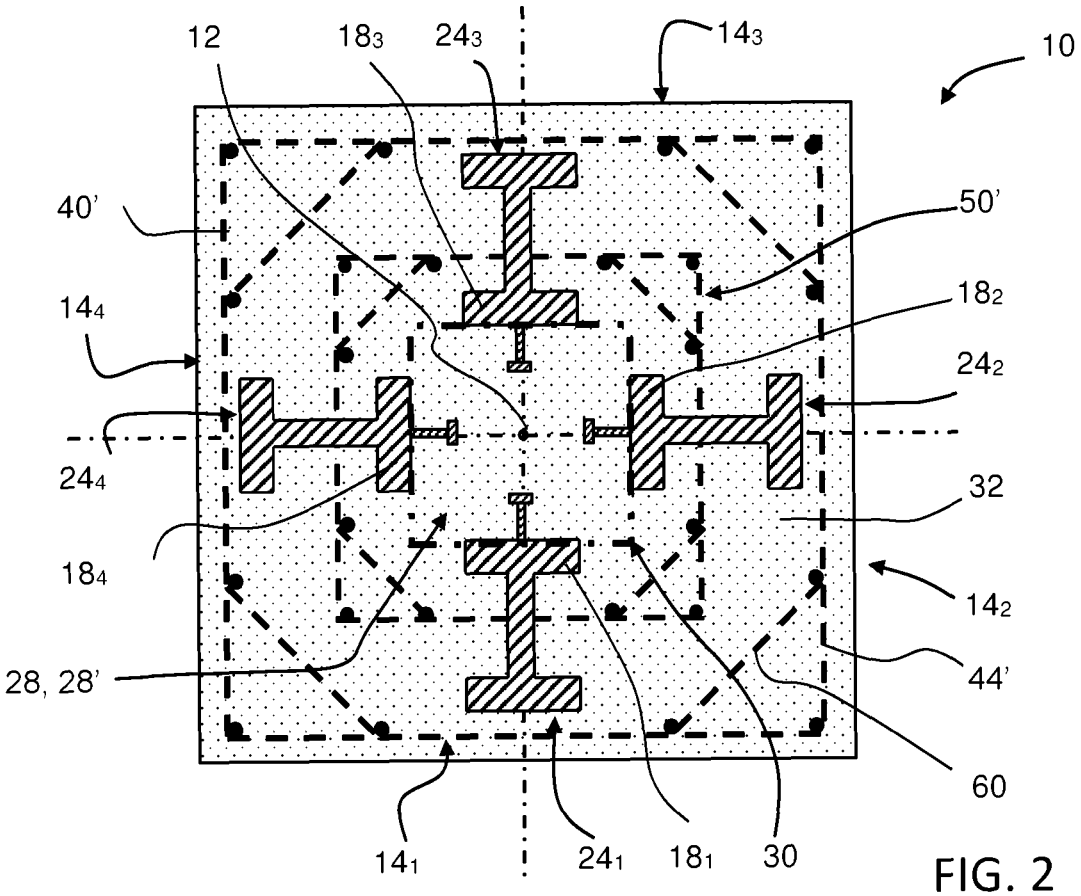
FIG. 2: is a cross-section of a second embodiment of a steel reinforced concrete column in accordance with the invention.

The column 10 of FIG. 2 distinguishes over the column 10 of FIG. 1 mainly by the following features. It has a square-shaped cross-section (instead of a circular cross-section), wherein its shell surface comprises four planar side surfaces $\mathbf{14}_i$, which are basically parallel to the outer surfaces $\mathbf{24}_i$ of the four outward flanges 22*i*. Each of the inward flanges $\mathbf{18}_i$ limits about 52% of the surface of the respective side of the 4-sided central concrete core 28'. In other words, the 4-sided central concrete core 28' is limited by the inward flanges $\mathbf{18}_i$ over about 52% of its perimeter surface 30. The outer concrete reinforcement cage 40' and the inner concrete reinforcement cage 50' comprise closed reinforcement rings 44' that are square-shaped. Rebar corner brackets 60 stiffen the square-shaped reinforcement rings 44', so that they are better suited for opposing a bulging of the concrete 32 under axial compression forces. This embodiment with square-shaped reinforcement rings 44' remains however less efficient for reducing a bulging of the concrete 32 than the embodiment with closed circular reinforcement rings 44.

Figure 6:
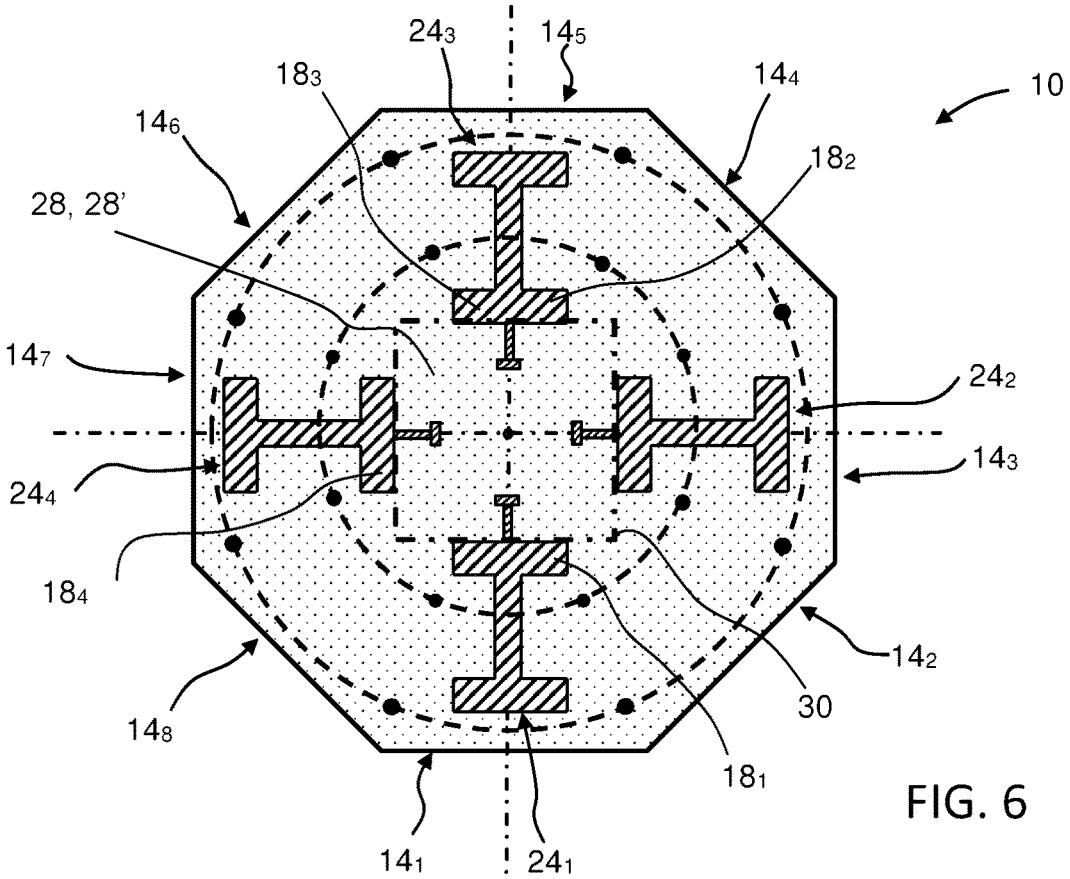
FIG. 6: is a cross-section of a third embodiment of a steel reinforced concrete column in accordance with the invention.

The column 10 of FIG. 6 distinguishes over the column 10 of FIG. 1 by mainly the following features. It has an octagonal cross-section, wherein its shell surface comprises eight planar side surfaces $\mathbf{14}_i$, of which every second side surface is basically parallel to the outer surface $\mathbf{24}_i$ of one of the four outward flanges $\mathbf{22}_i$. Each of the inward flanges $\mathbf{18}_i$ limits about 52% of the surface of the respective side of the central concrete core 28'. In other words, the central concrete core 28' is limited by the inward flanges $\mathbf{18}_i$ over about 52% of its perimeter surface 30. It is to be noted that closed circular reinforcement rings 44 fit very well in the octagonal section of the column 10, in which the concrete is much better used than in the column of FIG. 2.

Figure 7:
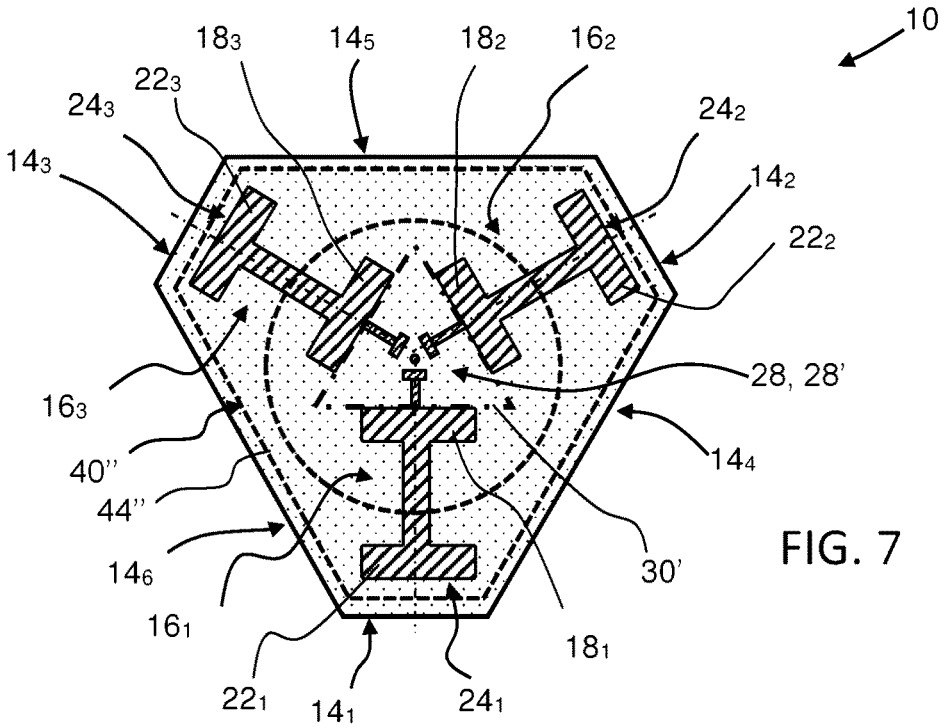
FIG. 7: is a cross-section of a fourth embodiment of a steel reinforced concrete column in accordance with the invention.

The column 10 of FIG. 7 distinguishes over the column 10 of FIG. 1 by mainly the following features. It only includes three steel sections $\mathbf{16}_i$ confining a central concrete core 28' that has a triangular cross-section 30'. The column 10 as a whole has a hexagonal cross-section, wherein its shell surface comprises three small planar side surfaces $\mathbf{14}_1$, $\mathbf{14}_2$, $\mathbf{14}_3$, which are basically parallel to the outer surfaces $\mathbf{24}_i$ of the three outward flange $\mathbf{22}_i$, and which alternate with three large planar side surfaces $\mathbf{14}_4$, $\mathbf{14}_5$, $\mathbf{14}_6$ ("large" and "small" referring here to the width of the side surfaces). Each of the inward flanges $\mathbf{18}_i$ covers about 75% of the surface of one of the three sides of the central concrete core 28'. The outer concrete reinforcement cage 40" comprises hexagonal reinforcement rings 44" having a similar outline as the hexagonal cross-section of the column 10. Such a column 10 is of particular interest if it has to support three horizontal beams arranged according to three different directions (here three directions mutually separated by angles of) 120°. (It remains to be noted that in FIG. 7 the longitudinal rebars are not shown.)

Figure 8:
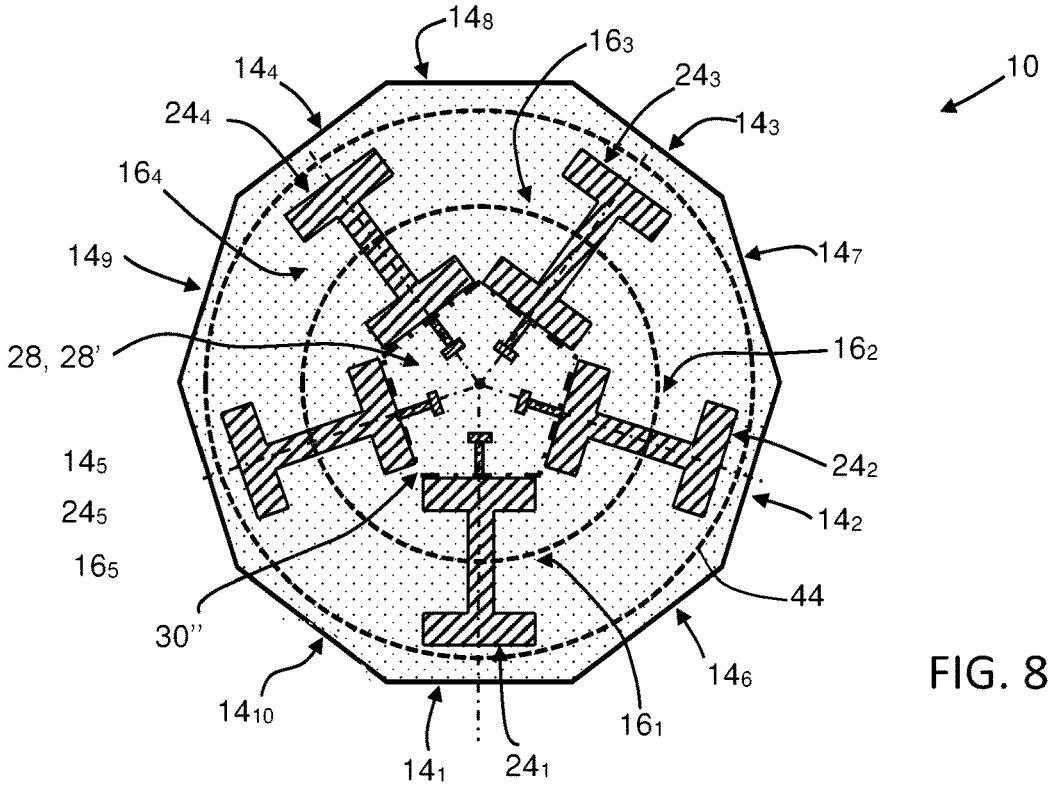
FIG. 8: is a cross-section of a fifth embodiment of a steel reinforced concrete column in accordance with the invention.

The column 10 of FIG. 8 distinguishes over the column 10 of FIG. 6 by mainly the following features. It includes five steel sections $\mathbf{16}_i$ that confine a central concrete core 28' having a pentagonal cross-section 30". The column 10 as a whole has a decagonal cross-section, wherein its shell surface comprises ten planar side surfaces $\mathbf{14}_i$, of which every second surface is basically parallel to the outer surface $24_i$ of one of the five outward flange $22_i$. Each of the inward flanges $18_i$ covers about 93% of the surface of the respective side of the central concrete core 28'. In other words, the central concrete core 28' is limited by the inward flanges $18_i$ over about 93% of its perimeter surface 30". Such an embodiment is of particular interest, if the column 10 has to support five horizontal beams arranged according to five different directions (here five directions separated by angles of 72°). (It remains to be noted that in FIG. 8 the longitudinal rebars are not shown.)

Figure 9:
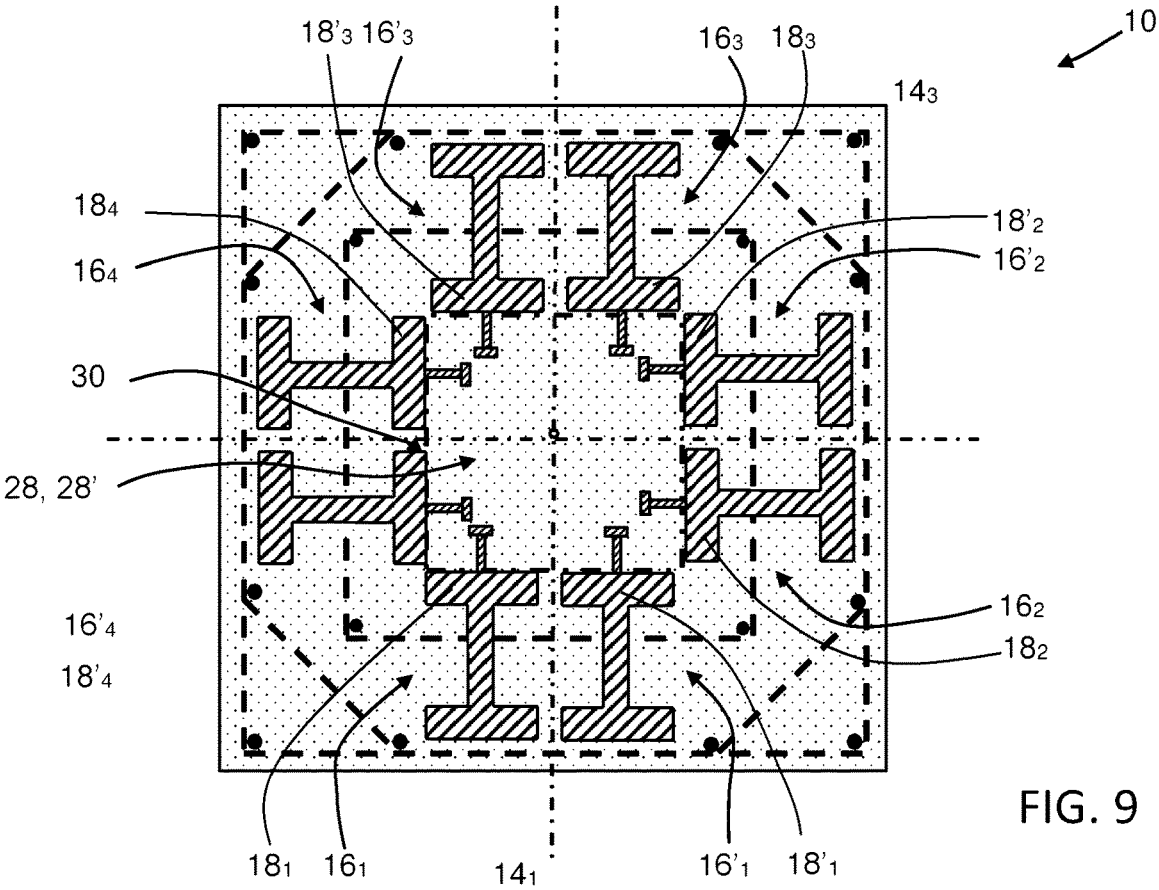
FIG. 9: is a cross-section of a sixth embodiment of a steel reinforced concrete column in accordance with the invention.

The column 10 of FIG. 9 distinguishes over the column 10 of FIG. 2 by mainly the following features. Along each side of the central concrete core 28', which also has a square-shaped cross-section 30, are arranged the inward flanges $18_i$, $18'_i$ of a pair of steel sections $16_i$, $16'_i$. The two inward flanges $18_i$, $18'_i$ limit about 85% of the surface of the respective side of the central concrete core 28'. Such an embodiment is of particular interest, if the column 10 has to support two parallel horizontal bearing beams on each of its four sides or if a particularly strong steel reinforced concrete column is required. Arranging the inward flanges $18_i$ of more than one steel sections $16_i$ along a side of the central concrete core 28' allows to design larger concrete cores 28' and, consequently, larger columns despite a limitation of the flange width of the commercially available steel sections.

In a further embodiment of the column (not shown), which comprises six steel sections and in which the central concrete core has a rectangular cross-section with two long sides and two short sides, the inward flanges of two steel sections are arranged along each of the two long sides and the inward flange of one steel section is arranged along each of the two short sides. Such an embodiment is of particular interest, if the column has to support two parallel horizontal bearing beams along a first direction and single (or no) horizontal bearing beams according to a second direction.

In all embodiments shown in the drawings, all the steel sections $16_i$ have the same dimensions and have inward flanges, respectively outward flanges having the same width. However, it is not excluded to have in the same steel reinforced concrete column: smaller and larger steel sections $16_i$; steel sections $16_i$ having inward flanges, respectively outward flanges with different widths.

In all embodiments shown in the drawings, the n sides of the central concrete core 28' all have the same width. However, it is not excluded to have a central concrete core whose sides have different widths. This would e.g. be the case for a central concrete core having a rectangular cross-section or a cross-section that is an irregular polygon.

In the embodiments of FIGS. 1, 2, 6, 7 and 8, the web of each of the steel sections $16_i$ has a midplane containing the longitudinal central axis 12 of the column 10. As shown e.g. by FIG. 9, this is however not necessarily the case.

While the columns shown in the drawings either have a circular, square-shaped, hexagonal, octagonal or decagonal cross-section, it will be understood that a column in accordance with the invention may have any kind of cross-section, including, for example: rectangular, cross-shaped and oval cross-sections, cross-sections that are regular or irregular polygons, cross-sections composed of curved lines etc.

It will further be understood that the cross-section of the column may decrease with the height. In such a case, the cross-section of the central concrete core may also decrease in the same proportion, so that the inward flanges of the steel sections may not be parallel to the longitudinal central axis of the column.

Figure 10:
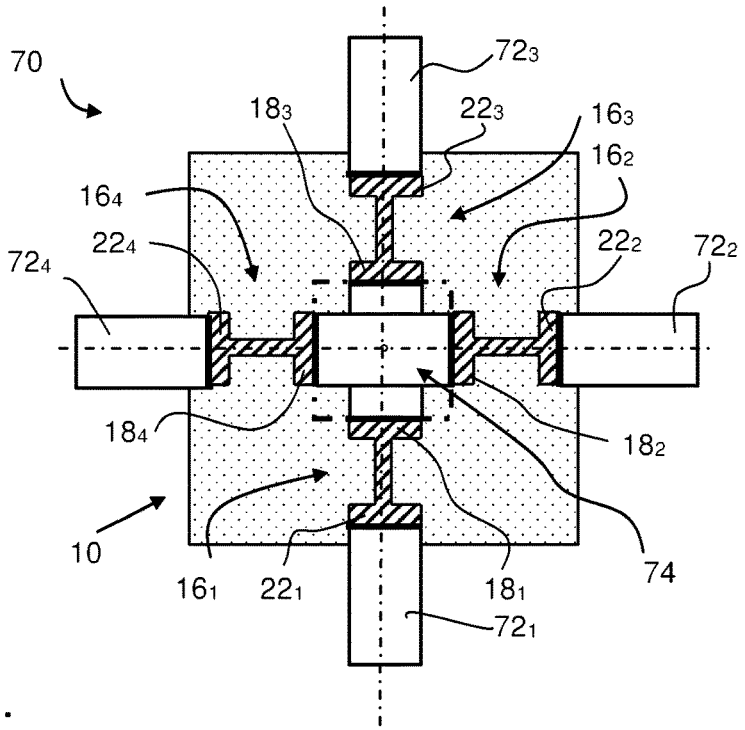
FIG. 10: is a cross-section of a steel reinforced concrete column as shown in FIG. 2, showing a beam-to-column connection, in which horizontal bearing beams are affixed to the steel reinforced concrete column.

FIG. 10 is cross-section of a column 10 as shown in FIG. 2, more particular at a so-called beam-to-column connection node 70, where—at a specific vertical location or level along the column 10—a horizontal bearing beam $72_i$ is secured to each of the outward flanges $22_i$ of the vertical column 10. Such horizontal bearing beams $72_i$ support e.g. a floor in a high rise building. Arrow 74 points to optional transversal structural steel advantageously interconnecting the inward flanges $18_i$ at the connection node 70, at the same level where the horizontal bearing beams $72_i$ are connected to the outward flanges $22_i$ of the column 10.

Figure 11:
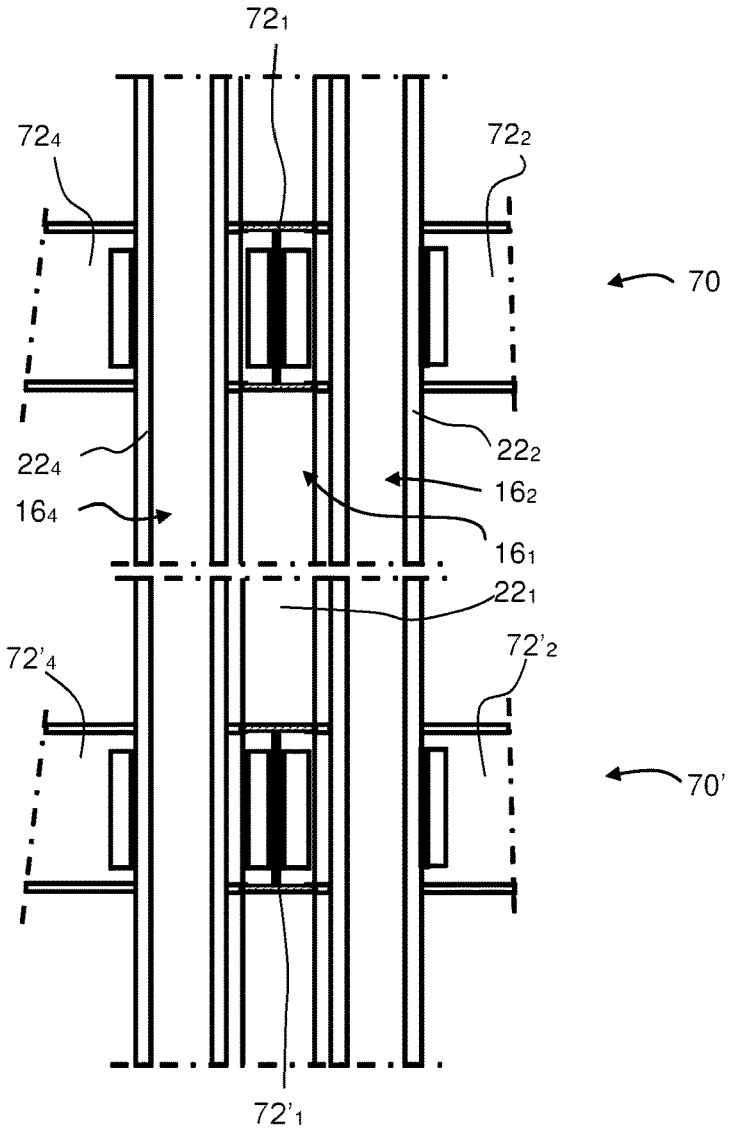
FIG. 11: is an elevation view of a column as shown in FIG. 1, 2 or 6, wherein concrete and concrete reinforcement bars are not shown.

FIG. 11 is an elevation view of a column as shown in FIG. 1, 2 or 6, wherein concrete and concrete reinforcement steel are not shown. This column 10 comprises at least two longitudinally spaced beam-to-column connection nodes 70, 70' as shown in FIG. 10, for supporting two successive floors. It will be noted that between the two longitudinally spaced beam-to-column connection nodes 70, 70' there is no structural steel interconnecting the steel sections $16_i$. In other words, between the two longitudinally spaced connection nodes 70, 70' of the column 10, the steel sections $16_i$ are structurally interconnected exclusively by the steel reinforced concrete 32.

While the present invention has been described more specifically with regard to a steel reinforced concrete column for a high rise building, it will be understood that a steel reinforced concrete column in accordance with the invention may also be used in nonbuilding structures such as e.g. huge halls, platforms, bridges, pylons etc.

Reference signs list

| | |
|---|---|
| 10 | steel reinforced concrete column |
| 12 | longitudinal central axis of 10 |
| 14 | shell surface of 10 |
| $14_i$ | side surfaces of 14 |
| $16_i$ | hot-rolled steel section |
| $18_i$ | inward flange of $16_i$ |
| $20_i$ | outer surface of $18_i$ |
| $22_i$ | outward flange of $16_i$ |
| $24_i$ | outer surface of $22_i$ |
| $26_i$ | web of $16_i$ |
| 28 | n-sided central core volume |
| 28' | n-sided central concrete core (= 28 filled with concrete) |
| 30 | outer limit of 28 (= perimeter surface of 28') |
| 32 | concrete |
| 34 | shear connector |
| 36 | shear connector |
| 38 | shear connector |
| 40 | outer reinforcement cage |
| 42 | vertical reinforcement bar (vertical rebar) |
| 44 | closed circular reinforcement ring |
| 44' | closed square-shaped reinforcement ring |
| 46 | mesh of 40 |
| 48 | helically wound continuous rebar |
| 50 | inner reinforcement cage |
| 52 | vertical reinforcement bars |
| 54 | closed circular reinforcement ring |
| 58 | helically wound continuous rebar |
| 60 | corner bracket |
| 70, 70' | beam-to-column connection node of 10 |
| $72_i$ | horizontal bearing beam |
| 74 | transversal structural steel interconnecting 18 |

The invention claimed is:

1. A steel reinforced concrete column for a high rise building comprising:

a plurality of hot-rolled steel sections extending longitudinally through the steel reinforced concrete column, each of these steel sections having an outward flange with an outer surface turned outwards in the steel reinforced concrete column, an opposite inward flange with an outer surface turned inwards in the steel reinforced concrete column, and a central web connecting the outward flange to the inward flange;

wherein:

all the steel sections that extend longitudinally through the steel reinforced concrete column are arranged in the steel reinforced concrete column so that the outer surfaces of all their inward flanges delimit therein a central concrete core with n lateral sides and a transversal cross-section that forms an n-sided polygon, n being at least equal to three, each of the n lateral sides of the central concrete core being coplanar with the outer surface of the inward flange of at least one steel section of the plurality of hot-rolled steel sections;

the steel reinforced concrete column has a longitudinal axis along which the steel sections extend, so that a longitudinal axis of each steel section is parallel to the longitudinal axis of the steel reinforced concrete column; and the central concrete core having a central axis coincident with the longitudinal axis of the steel reinforced concrete column, and the central axis of the central concrete core formed of only concrete or concrete with one or more transversal steel members interconnecting the inward flange of one of the plurality of hot-rolled steel sections with the inward flange of another of the plurality of hot-rolled steel sections.

2. The steel reinforced concrete column according to claim 1, wherein at least 30% of the surface of each of the n lateral sides of the concrete core are limited by the outer surface of the inward flange of one or more steel sections of the plurality of hot-rolled steel sections.

3. The steel reinforced concrete column according to claim 1, wherein: a first side of the n lateral sides of the central concrete core that is coplanar with the outer surface of the inward flange of a single steel section of the plurality of hot-rolled steel sections has the inward flange of the single steel section centred relative to the width of the first side of the central concrete core.

4. The steel reinforced concrete column according to claim 1, wherein all the inward flanges of the plurality of steel sections have the same width.

5. The steel reinforced concrete column according to claim 1, wherein all the steel sections have the same dimensions.

6. The steel reinforced concrete column according to claim 1, wherein the central concrete core has a transversal cross-section that forms an n-sided convex polygon.

7. The steel reinforced concrete column according to claim 1, wherein the central concrete core has a transversal cross-section that forms a regular polygon.

8. The steel reinforced concrete column according to claim 1, wherein the n lateral sides of the central concrete core all have the same width.

9. The steel reinforced concrete column according to claim 1 having a longitudinal axis, wherein for a side of the n lateral sides of the central concrete core that is coplanar to the outer surface of the inward flange of a single steel section of the plurality of hot-rolled steel sections, the web of the corresponding steel section has a midplane containing the longitudinal axis of the steel reinforced concrete column.

10. The steel reinforced concrete column according to claim 1, wherein the steel sections form an arrangement of which the longitudinal central axis of the steel reinforced concrete column is an axis of rotational symmetry.

11. The steel reinforced concrete column according to claim 1, wherein each inward flange comprises a multitude of shear connectors penetrating into the central concrete core.

12. The steel reinforced concrete column according to claim 1, wherein each of the steel sections comprises a multitude of shear connectors penetrating into the concrete between its outward and inward flanges and/or into the concrete surrounding the outer surface of its outward flange.

13. The steel reinforced concrete column according to claim 1, comprising longitudinal and/or transversal rebars.

14. The steel reinforced concrete column according to claim 1, comprising an outer reinforcement cage formed of longitudinal and transversal rebars and enclosing the plurality of hot-rolled steel sections.

15. The steel reinforced concrete column according to claim 14, wherein the outer reinforcement cage comprises a multitude of closed circular rebar rings connected to the longitudinal rebars.

16. The steel reinforced concrete column according to claim 1, wherein the concrete comprises an inner reinforcement cage arranged between the outer flanges and the inward flanges so as to enclose the central concrete core.

17. The steel reinforced concrete column according to claim 16, wherein the inner reinforcement cage comprises a multitude of closed circular rebar rings passing through holes in the webs of the steel sections.

18. The steel reinforced concrete column according to claim 16, wherein the inner reinforcement cage comprises cage comprises arc-shaped segments of rebar rings welded with their ends to the webs of the steel sections.

19. The steel reinforced concrete column according to claim 1, further comprising:

at least two longitudinally spaced beam-to-column connection nodes for connecting thereto load bearing beams, wherein, between two successive beam-to-column connection nodes of the at least two longitudinally spaced beam-to-column connection nodes, there is no structural steel interconnecting the steel sections.

20. The steel reinforced concrete column according to claim 1, comprising at least one beam-to-column connection element on the outward flange of at least one steel section of the plurality of hot-rolled steel sections.

21. The steel reinforced concrete column according to claim 1 having a round or oval or generally curvilinear cross-section.

22. The steel reinforced concrete column according to claim 1 having a polygonal cross-section.

23. The steel reinforced concrete column according to claim 22, having a polygonal cross-section with 2n sides.

24. A steel structure for a steel reinforced concrete column comprising:

a plurality of hot-rolled steel sections arranged so as to extend longitudinally through the steel structure, so that in the steel reinforced concrete column a longitudinal axis of each steel section of the plurality of hot-rolled steel sections is parallel to a longitudinal axis of the steel reinforced concrete column, each of the steel sections of the plurality of hot-rolled steel sections having an outward flange with an outer surface turned outwards in the steel structure, an opposite inward flange with an outer surface turned inwards in the steel structure, and a web connecting the outward flange to the inward flange;

wherein all the steel sections that extend longitudinally through the steel structure are arranged so that:

the outer surfaces of all their inward flanges delimit a central core volume with n lateral sides and a transversal cross-section that forms a n-sided polygon, n being at least equal to three;

each of the n lateral sides of the central core volume being coplanar with the outer surface of the inward flange of at least one steel section of the plurality of hot-rolled steel sections, the central core volume having a central axis coincident with to the longitudinal axis of the steel reinforced concrete column, and the central axis of the central core volume is fillable with only concrete or concrete with one or more transversal steel members interconnecting the inward flange of one of the plurality of hot-rolled steel sections with the inward flange of another of the plurality of hot-rolled steel sections are located, so as to form a central concrete core of the steel reinforced concrete column.

25. The steel structure according to claim 24, further comprising:

at least two longitudinally spaced beam-to-column connection nodes for connecting thereto load bearing beams, wherein between two successive beam-to-column connection nodes of the at least two longitudinally spaced beam-to-column connection nodes, there is no structural steel interconnecting the steel sections.

26. A high-rise building comprising at least one steel reinforced concrete column according to claim 1.

27. The high rise building according to claim 26, the at least one steel reinforced concrete column comprising at least two longitudinally spaced beam-to-column connection nodes, at least two successive floors supported by the steel reinforced concrete column at two successive beam-to-column connection nodes of the at least two longitudinally spaced beam-to-column connection nodes, wherein:

at each of the beam-to-column connection nodes of the at least two longitudinally spaced beam-to-column connection nodes, the steel sections are structurally interconnected by means of structural steel; and between the two successive beam-to-column connection nodes, there is no structural steel interconnecting the steel sections of the plurality of hot-rolled steel sections.

28. A composite steel-concrete column for a high rise building comprising:

concrete, the concrete being steel-reinforced concrete; and a plurality of hot-rolled steel sections extending longitudinally through the composite steel-concrete column, each of these steel sections having an outward flange with an outer surface turned outwards in the composite steel-concrete column, an opposite inward flange with an outer surface turned inwards in the composite steel-concrete column, and a central web connecting the outward flange to the inward flange;

wherein all the steel sections that extend longitudinally through the steel reinforced concrete column are arranged in the composite steel-concrete column so that the outer surfaces of all their inward flanges delimit within the concrete a central concrete core with n lateral sides and a transversal cross-section that forms an n-sided polygon, n being at least equal to three, each of the n lateral sides of the central concrete core being coplanar with the outer surface of the inward flange of at least one steel section of the plurality of hot-rolled steel sections;

wherein the steel sections block transversal expansion of the central concrete core under compression forces and thereby provide confinement of the central concrete core;

wherein the composite steel-concrete column has a longitudinal axis along which the steel sections extend, so that a longitudinal axis of each steel section is parallel to the longitudinal axis of the composite steel-concrete column, and the central concrete core having a central axis coincident with to the longitudinal axis of the composite steel-concrete column, and the central axis of the central concrete core formed of only concrete or concrete with one or more transversal steel members interconnecting the inward flange of one of the plurality of hot-rolled steel sections with the inward flange of another of the plurality of hot-rolled steel sections.

29. The steel reinforced concrete column according to claim 1, wherein the steel reinforced concrete column comprises n steel sections, n being the number of lateral sides of the central concrete core.

* * * * *